US006368157B1

(12) United States Patent
Bottazzi, Jr.

(10) Patent No.: US 6,368,157 B1
(45) Date of Patent: Apr. 9, 2002

(54) ADAPTER FOR CONNECTING VARIOUS ELECTRONIC DEVICES TO A CIGARETTE ACCESSORY SOCKET

(76) Inventor: Joseph Bottazzi, Jr., 66 William St., Little Falls, NJ (US) 07424

( * ) Notice: Subject to any disclaimer, the term of this patent is extended or adjusted under 35 U.S.C. 154(b) by 0 days.

(21) Appl. No.: 09/829,368

(22) Filed: Apr. 9, 2001

(51) Int. Cl.[7] ..... H01R 24/04
(52) U.S. Cl. ..... 439/668; 439/441
(58) Field of Search ..... 439/441, 490, 439/668, 669

(56) References Cited

U.S. PATENT DOCUMENTS

| | | | | | |
|---|---|---|---|---|---|
| 2,954,544 | A | * | 9/1960 | Focosi | 439/668 |
| 3,099,505 | A | * | 7/1963 | Sciwartz | 439/441 |
| 3,377,610 | A | * | 4/1968 | Busch et al. | 439/441 |
| 3,865,463 | A | * | 2/1975 | Busch | 439/668 |
| 4,322,122 | A | * | 3/1982 | Schwartz et al. | 439/621 |
| 5,131,869 | A | * | 7/1992 | Wharton | 439/622 |
| 5,263,879 | A | * | 11/1993 | Sasa et al. | 439/668 |
| 5,593,323 | A | * | 1/1997 | Dernehl | 439/668 |
| 5,775,952 | A | * | 7/1998 | Lu | 439/668 |
| 5,860,824 | A | * | 1/1999 | Fan | 439/265 |
| 5,964,623 | A | * | 10/1999 | Maher et al. | 439/668 |

* cited by examiner

*Primary Examiner*—Brian Sircus
*Assistant Examiner*—Thanh-Tam Le
(74) *Attorney, Agent, or Firm*—Walter J. Tencza, Jr.

(57) ABSTRACT

An apparatus or adapter is disclosed comprising a first conductor and a second conductor. The first conductor is adapted to be electrically connected to a central terminal of a cigarette lighter accessory socket and the second conductor adapted to be electrically connected to an outer terminal of the cigarette lighter accessory socket. The first conductor and the second conductor may be attached to a housing. The first conductor may be comprised of a first portion, which may be a conductive thimble, a second portion, and a third portion, which may be a spring shaped conductor. The apparatus may be further comprised of a first conductive terminal electrically connected to the first conductor, and a second conductive terminal electrically connected to the second conductor. A first device may be provided for attaching a first electrical lead to the first conductive terminal, and a second device may be provided for attaching a second electrical lead to the second conductive terminal. The first device may be comprised of a first spring and a first spring loaded member, and the second device may be comprised of a second spring and a second spring loaded member. A light may be electrically connected to the first conductor and the second conductor. The light may indicate when the apparatus has been electrically connected to a cigarette lighter accessory socket.

18 Claims, 3 Drawing Sheets

ADAPTER FOR CONNECTING VARIOUS ELECTRONIC DEVICES TO A CIGARETTE ACCESSORY SOCKET

FIELD OF THE INVENTION

This invention relates to improved methods and apparatus for connecting devices to an accessory socket such as a twelve volt accessory socket or cigarette lighter socket found standard in most if not all cars, trucks, and boats.

1. Background of the Invention

Typically in the prior art, devices for connecting to a cigarette adapter would come with a plug that fits into the cigarette adapter. However some devices are not equipped with such a plug.

2. Summary of the Invention

The present invention in at least one embodiment provides an apparatus or adapter comprising a first conductor and a second conductor. The first conductor is adapted to be electrically connected to a central terminal of a cigarette lighter accessory socket and the second conductor adapted to be electrically connected to an outer terminal of the cigarette lighter accessory socket. The first conductor and the second conductor may be attached to a housing. The first conductor may be comprised of a first portion, which may be a conductive thimble, a second portion, and a third portion, which may be a spring shaped conductor.

The apparatus may be further comprised of a first conductive terminal electrically connected to the first conductor, and a second conductive terminal electrically connected to the second conductor. A first device may be provided for attaching a first electrical lead to the first conductive terminal, and a second device may be provided for attaching a second electrical lead to the second conductive terminal. The first device may be comprised of a first spring and a first spring loaded member, and the second device may be comprised of a second spring and a second spring loaded member. A light may be electrically connected to the first conductor and the second conductor. The light may indicate when the apparatus has been electrically connected to a cigarette lighter accessory socket.

DETAILED DESCRIPTION OF THE DRAWINGS

Figure 1:
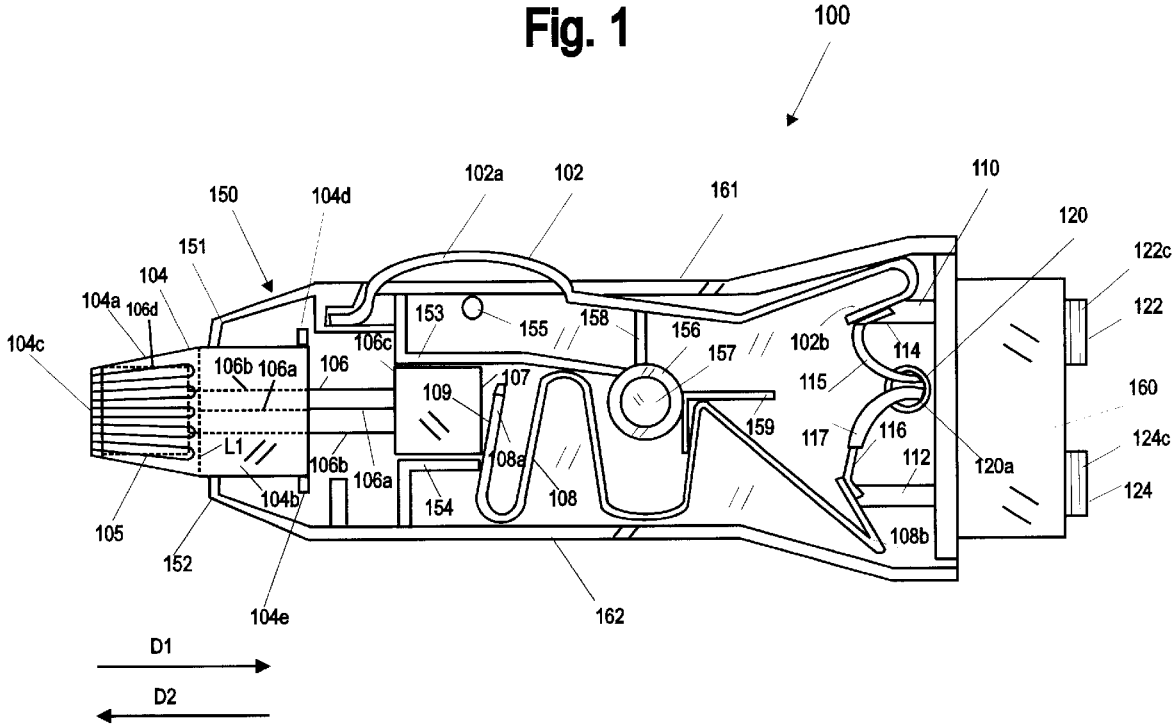
FIG. 1 shows an internal view of a first portion of an adapter in accordance with an embodiment of the present invention.

FIG. 1 shows an internal view of a first portion 100 of an adapter 300 (shown in FIGS. 3 and 4) in accordance with an embodiment of the present invention. The first portion 100 includes a conductor 102, having a curved portion 102*a*. The curved portion 102*a* is of a shape and size that can fit into a cigarette lighter or adapter found in most automobiles and boats. The conductor 102 includes a portion 102*b* which is electrically connected to an conductive terminal 110. Portion 102*b* is also electrically connected to a conductor 114. Conductor 114 passes through an insulator 115 and is electrically connected to a light 120 at portion 120*a* of the light 120.

The first portion 100 also includes a conductive thimble 104 having portions 104*a* and 104*b* which for descriptive purposes are shown separated by dashed line L1. Thimble 104 also has an end 104*c*. Portion 104*a* of the conductive thimble has a gradually decreasing diameter from line L1 to end 104*c*. The portion 104*a* is designed to fit into a cigarette lighter accessory socket of an automobile or boat. The portion 104*a* includes a plurality of grooves such as groove 105. The portion 104*a* is substantially cone shaped. The portion 104*b* is substantially cylindrical. Portions 104*a* and 104*b* in this embodiment are hollow. The conductive thimble 104 includes extensions 104*d* and 104*e*, which will prevent the thimble 104 from falling out of the completed adapter 300 shown in FIG. 3.

The first portion 100 of the adapter 300 also includes a conductor 106. The conductor 106 may be comprised of conductor 106*a*, and portions 106*b*, 106*c*, and 106*d*. Portion 106*c* and 106*d* may be made of metal. Portion 106*d* and part of portion 106*c* are shown in dashed lines in FIG. 1, because they would lie inside the conductive thimble 104 and electrically contact the end 104*c* of the thimble 104. Portion 106*b* can be made of plastic or glass and connects the portion 106*d* with the portion 106*c*, shown in FIG. 1. Portion 106*c* can be made of metal. Portion 106*d* can be electrically connected to portion 106*c* by a conductor 106*a* running through the portion 106*b*.

The first portion 100 also includes a conductor 108. The conductor 108 functions as a spring. The conductor 108 includes a portion 108*a* which has a surface 109 which can be made to electrically contact a surface 107 of the portion 106*c* of the conductor 106. The conductor 108 also has a portion 108*b* which is electrically connected to a conductive terminal 112 and to a conductor 116. The conductor 116 passes through insulator 117, and the conductor 116 is electrically connected to a light 120 at a portion 120*a* of the light 120.

The combination of the conductive thimble 104, the conductor 106, and conductor 108 can also be described as a first conductor, and 104, 106, and 108 can be thought of as portions of that first conductor. The conductor 102 can be thought of as a second conductor.

The first portion 100 of the adapter 300 also includes housing 150. The housing 150 may be plastic. The housing 150 is comprised of portions 151, 152, 153, 154, 155, 156, 157, 159, 160, 161, and 162. Portions 151 and 152 are used to hold the conductive thimble 104 in position so that when portions 100 and 200 are combined to form apparatus 300 of FIG. 3, the conductive thimble 104 is held in place, except that the conductive thimble can be pushed in direction D1 shown in FIG. 1 or may come out in direction D2. When the adapter 300 is inserted into a cigarette adapter or lighter, the conductive thimble 104 is pushed in the direction D1 causing electrical contact between the surface 107 of the portion 106*c* of conductor 106 and the surface 109 of the portion 108*a* of conductor 108.

The portions 153 and 154 of the housing 150 hold the portion 106*c* of the conductor 106 in place so that it does not move substantially when portions 100 and 200 are combined to form apparatus 300 with the exception that portion 106*c* can move in directions D1 or D2 shown in FIG. 1. The portion 155 of the housing 150 is a peg which helps to align first portion 100 and second portion 200 of the adapter 300. Portions 156 and 157 are a rim and the inner surface of a threaded screw hole. A screw 302 (shown in FIG. 4) can be inserted therein to connect first portion 100 to second portion 200.

Figure 3:
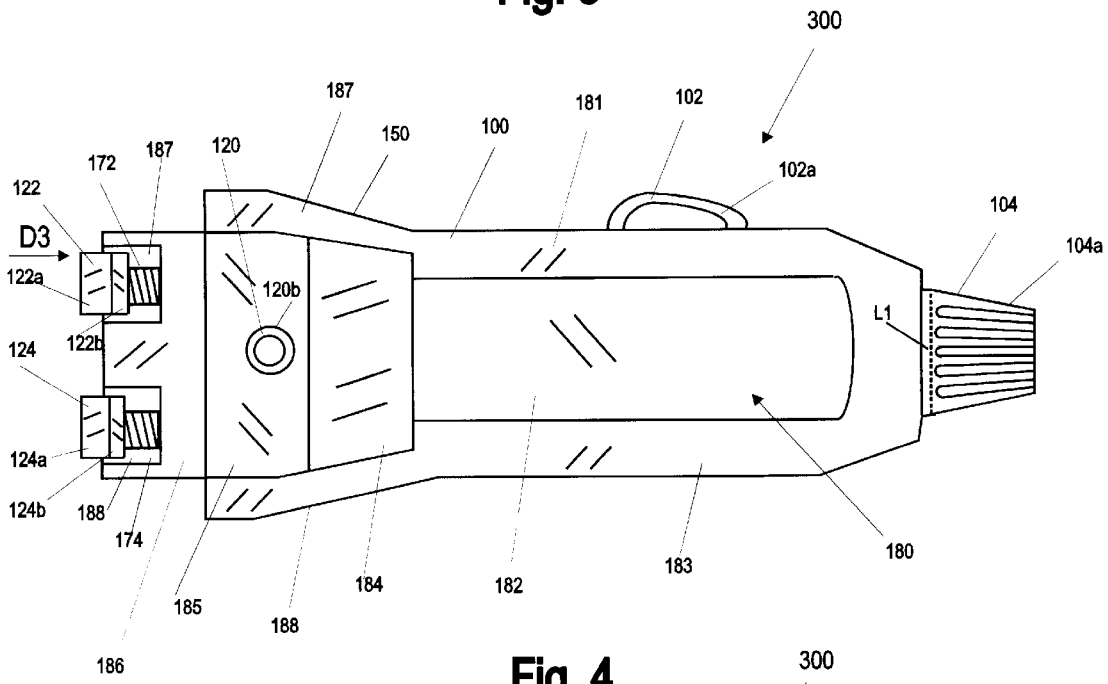
FIG. 3 shows a left side external view of an adapter comprised of the first portion of FIG. 1 and the second portion of FIG. 2.

Portion 158 and also portion 153 of the housing 150 assist in maintaining conductor 102 in a stationary position. Portion 159 of the housing 150 assists in maintaining conductor 108 in a stationary position. Despite their relatively stationary positions, both conductors 102 and 108 can be flexed and are flexed to cause appropriate operation. The housing 150 also includes housing 160, through which conductive terminals 114 and 112 pass and in which springs 172 and 174 shown in FIG. 3 are located. The housing 150 also includes external housing 161 and 162.

The first portion 100 shown in FIG. 1 is also comprised of spring loaded members 122 and 124, having ridged portions 122*c* and 124*c*, respectively. The spring loaded members 122 and 124 can be pushed open to allow insertion of conductors for connected various electronic devices to the adapter 300 and thus to the cigarette lighter or cigarette adapter of a car or boat. The combination of the spring 174 and the spring loaded member 124 can be described as a first device for attaching a first electrical lead to the conductive terminal 112. The combination of the spring 172 and the spring loaded member 122 can be described as a second device for attaching a second electrical lead to the conductive terminal 114.

Figure 2:
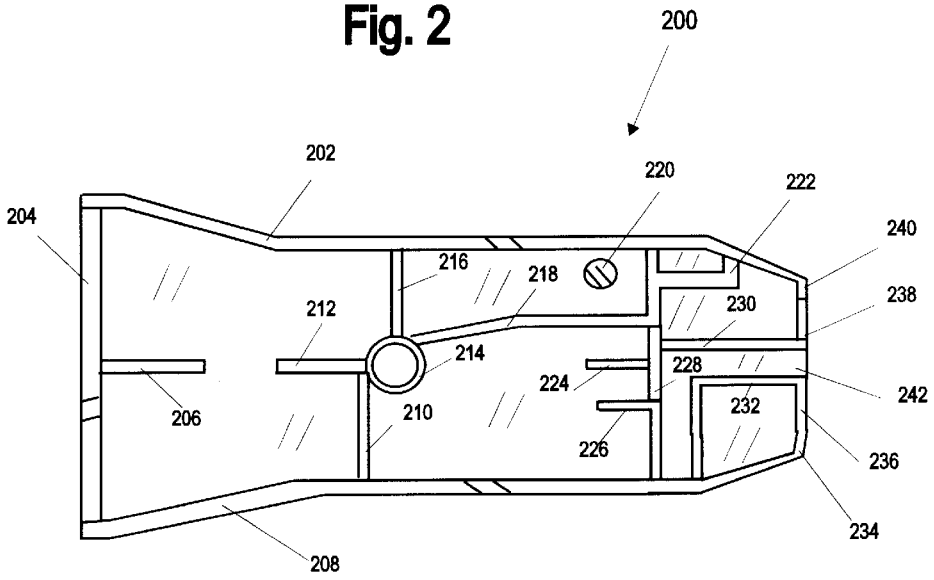
FIG. 2 shows an internal view of a second portion of an adapter for use with the first portion of the adapter of FIG. 1.

FIG. 2 shows an internal view of the second portion 200 of the adapter 300 for use with the first portion 100 of FIG. 1. The second portion 200 is a plastic housing. The second portion 200 is comprised of portions 202, 204, 206, 208, 210, 212, 214, 216, 218, 220, 222, 224, 226, 228, 230, 232, 234, 236, 238, 240, and 242. Portions 234, 236, 238, and 240 assist in maintaining conductive thimble 104 in position. Portion 242 is a gap which along with gap portion 190 in FIG. 5 allow the extensions 104*d* and 104*e* of the thimble 104 to be taken out of the adapter 300 when needed. The extensions 104*d* and 104*e* are the same size and each is slightly smaller than the gap portions 242 and 190. Portions 218, 224, and 226 assist in maintaining portion 106*c* of the conductor 106 in FIG. 1 in position. Portion 214 will overlay portion 156 in FIG. 1, and screw 302 goes through portion 214 and into portion 156. Portions 210 and 212 help to maintain conductor 108 in position.

FIG. 3 shows a left side external view of the adapter 300 comprised of the first portion 100 of FIG. 1 and the second portion 200 of FIG. 2. FIG. 3 shows external housing portions 180, 181, 182, 183, 184, 185, and 186. FIG. 3 also shows portions 122*a* and 122*b* of the spring loaded member 122 and portions 124*a* and 124*b* of the spring loaded member 124. Also shown is spring 172 which is attached to spring loaded member 122 and spring 174 which is attached to spring loaded member 124. The springs 172 and 174 and the corresponding spring loaded member 122 and 124 are shown in FIG. 3 in their rest state, without pressure being applied in the direction D3 by an individual. FIG. 3 also shows portion 120*b* of the light 120. Portion 120*b* lights when the adapter 300 is electrically connected to a cigarette lighter adapter of an automobile or boat. There are spaces 187 and 188 near the springs 172 and 174, respectively, into which the spring loaded members 122 and 124 can be pushed in the direction D3 in order to insert electrical leads into openings 404 and 414 shown in FIG. 6B.

Figure 4:
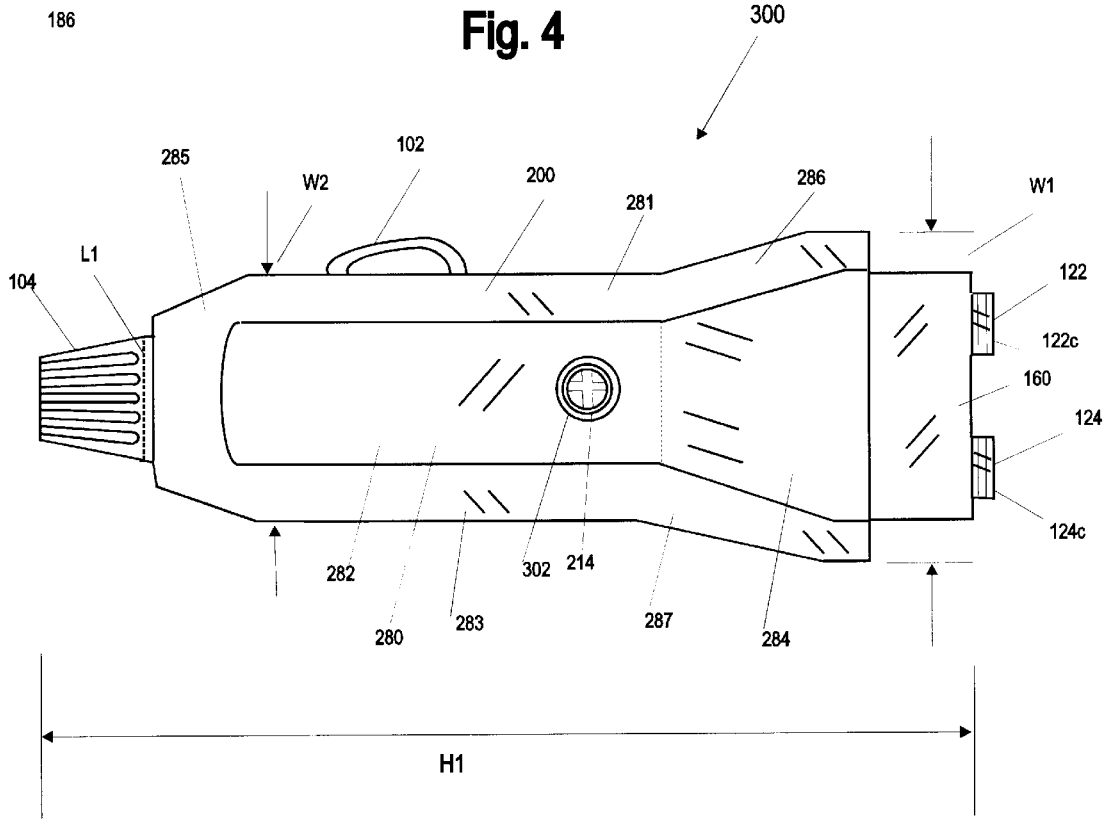
FIG. 4 shows a right side external view of an adapter comprised of the first portion of FIG. 1 and the second portion of FIG. 2.

FIG. 4 shows a right side external view of the adapter 300 comprised of the first portion 100 of FIG. 1 and the second portion 200 of FIG. 2. External housing portions 280, 281, 282, 283, 284, 285, 286, and 287 are shown in FIG. 4. Screw 302, which holds first portion 100 and second portion 200 together, is shown in FIG. 4. Housing 160 is also shown in FIG. 4.

Figure 5:
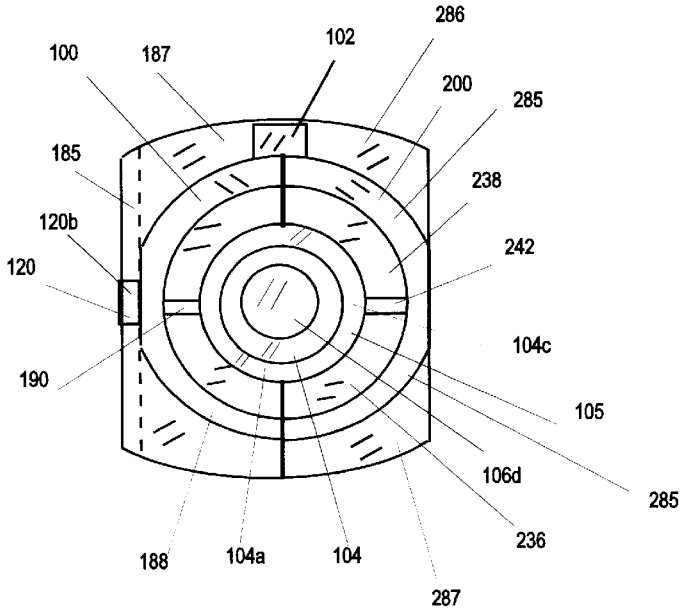
FIG. 5 shows a front external view of the adapter of FIGS. 3 and 4.

FIG. 5 shows a front external view of the adapter 300 of FIGS. 3 and 4. The portion 106*d* of the conductor 106 can be seen through an opening at end 104*c* of the conductive thimble 104. FIG. 5 shows groove 105 and thimble portion 104*a*. FIG. 5 shows a front view of conductor 102 and the light 120 including portion 120*b*. FIG. 5 shows various housing portions including portions 187, 185, and 188 of first portion 100 and portions 286, 285, 238, 285, 236, and 287 of second portion 200. FIG. 5 also shows gaps 190 and 242.

Figure 6A:
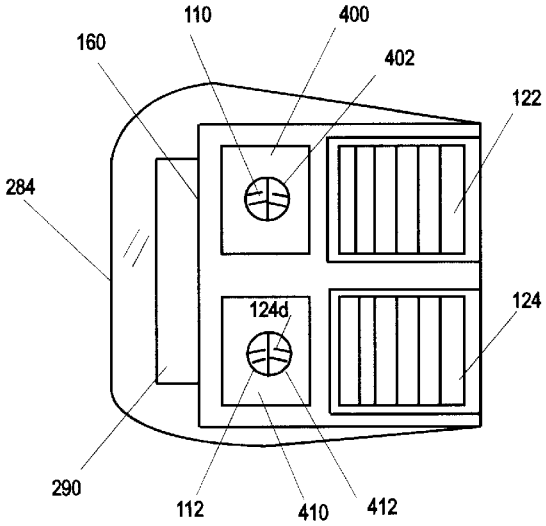
FIG. 6A shows a rear external view of the adapter of FIGS. 3 and 4 with spring loaded members at rest.
Figure 6B:
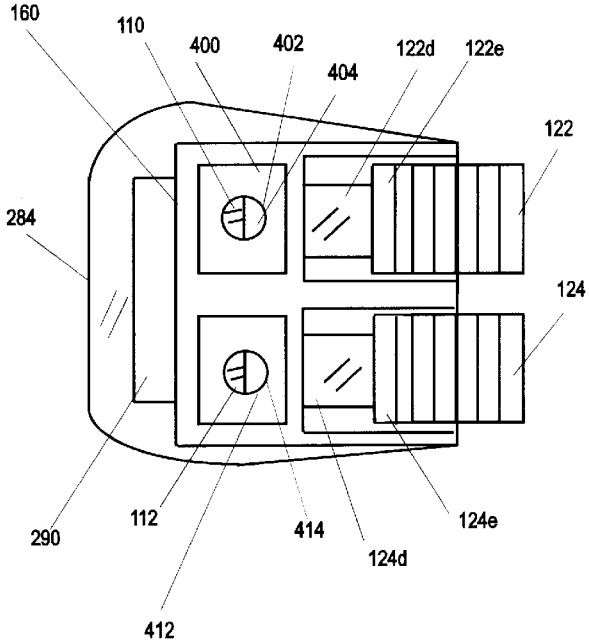
FIG. 6B shows a rear external view of the adapter of FIGS. 3 and 4 with the spring loaded members in a flexed state.

FIG. 6A shows a rear external view of the adapter 300 of FIGS. 3 and 4 with spring loaded members 122 and 124 at rest, i.e. without an external force being applied. In FIG. 6A terminal areas 400 and 410 are shown. The terminal areas 400 and 410 include circular openings 402 and 412, respectively. Through the circular openings 402 and 412, the conductive terminals 110 and 112 appear. Conductors or leads can be electrically connected to conductive terminals 110 and 112. At rest portions 122*d* and 124*d* of the spring loaded members 122 and 124 appear through the circular openings 402 and 412, respectively. When a force is applied into the page on to both members 122 and 124, with respect to FIG. 6B, the spring loaded members 122 and 124 change position as seen by FIG. 6B. This creates openings 404 and 414 shown in FIG. 6B. A positive electrical lead can be inserted into opening 404 and a negative electrical lead can be inserted into opening 414. Afterwards, the force on spring loaded members 122 and 124 can be released allowing members 122 and 124 to exert pressure on the positive and negative leads to keep them in place.

In operation the adapter 300 can be inserted into a cigarette lighter accessory of an automobile or boat. The adapter 300 is inserted so that the curved portion 102*a* makes an electrical connection with the outside conductor (which may also be called outside terminal or outside lead) of the cigarette lighter accessory, and so that the thimble 104 end 104*c* makes an electrical connection with the central conductor (which may also be called central terminal or central lead) of the cigarette light accessory. For example, the curved portion 102*a* may be electrically connected to a positive terminal of the cigarette lighter accessory and the thimble end 104*c* may be electrically connected to a negative terminal of the cigarette lighter accessory. When the adapter 300 is full electrically connected to the cigarette lighter accessory, the surface 107 of the conductor portion 106*c* will be in electrical contact with the conductor 108. In this example, current flows from the positive terminal of the cigarette lighter accessory through the curved portion 102*a* of the conductor 102 and to the conductive terminal 110 of FIG. 1. The current flows into the electronic apparatus connected to conductive terminal 110 through opening 402 of FIGS. 6A and 6B. The current flows through the electronic apparatus and then into opening 412 and to conductive terminal 112 of FIGS. 6A and 6B. The current flows from conductive terminal 112 through conductor 108 and 106 and through thimble 104 and through the negative terminal of the cigarette lighter accessory to complete a circuit. In addition to this circuit, the light 120 is connected through conductors 114 and 116 to conductors 102 and 108 respectively, and will turn on when the thimble conductor

104 is electrically connected to the central cigarette lighter accessory terminal and when the conductor 102 is electrically connected to the outer cigarette lighter accessory terminal. The light 120 indicates that the adapter 300 is functioning properly.

The adapter 300 can be a twelve volt accessory with spring loaded terminals for positive and negative connections. The spring loaded members 122 and 124 can be colored black and red respectively (or vice versa). The light 120 may be a red light, which becomes active when a connection is made to a twelve-volt source. The adapter 300 can be approximately three and one-quarter inches in height, H1, and have a greatest width of W1, which may be one inch, and another width, W2, which may be 0.75 inches shown in FIG. 4.

The adapter 300 can be used to connect various automotive and marine electronics to a twelve volt accessory socket without the need to open and solder the connections. It can benefit those that are uncomfortable with making electronic connections or as a time saver for those that are familiar. The adapter 300 can be used to connect, for example, a marine radio, a CB radio, or a boat antenna to a cigarette lighter accessory (also called a twelve volt accessory socket).

The adapter 300 can be sold at electronic, automotive and marine stores. Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a first conductor;

a second conductor;

a housing wherein the first conductor and the second conductor are attached to the housing;

the first conductor adapted to be electrically connected to a central terminal of a cigarette lighter accessory socket; and the second conductor adapted to be electrically connected to an outer terminal of the cigarette lighter accessory socket;

a first conductive terminal electrically connected to the first conductor;

a second conductive terminal electrically connected to the second conductor;

a first device for electrically connecting and attaching a first electrical lead to the first conductive terminal;

a second device for electrically connecting and attaching a second electrical lead to the second conductive terminal;

wherein the first device is comprised of a first spring and a first spring loaded member and the second device is comprised of a second spring and a second spring loaded member and;

wherein the first electrical lead can be electrically connected and attached to the first conductive terminal by applying a first force to a portion of the first spring loaded member which allows insertion of the first electrical lead into the housing;

wherein the second electrical lead can be electrically connected and attached to the second conductive terminal by applying a second force to a portion of the second spring loaded member which allows insertion of the second electrical lead into the housing;

wherein the first force creates a first opening allowing the first electrical lead to be inserted through the first opening into the housing and subsequently when the first force is released, the first spring loaded member exerts pressure on the first electrical lead to electrically connect and attach the first electrical lead to the first conductive terminal; and wherein the second force creates a second opening allowing the second electrical lead to be inserted through the second opening into the housing and subsequently when the second force is released, the second spring loaded member exerts pressure on the second electrical lead to electrically connect and attach the second electrical lead to the second conductive terminal.

2. The apparatus of claim 1 wherein the portion of the first spring loaded member to which the first force is applied lies outside the housing and the portion of the second spring loaded member to which the second force is applied lies outside the housing.

3. The apparatus of claim 1 wherein the first conductor is comprised of:

a first portion;

a second portion; and a third portion.

4. The apparatus of claim 3 wherein the first portion of the first conductor is a conductive thimble.

5. The apparatus of claim 3 wherein the third portion of the first conductor is in the form of a spring.

6. The apparatus of claim 2 wherein the first conductor and the second conductor are electrically connected to a light which lights when both the first conductor is electrically connected to the central terminal of the cigarette lighter accessory socket and the second conductor is electrically connected to the outer terminal of the cigarette lighter accessory socket.

7. The apparatus of claim 1 wherein the first conductor and the second conductor are electrically connected to a light which lights when both the first conductor is electrically connected to the central terminal of the cigarette lighter accessory socket and the second conductor is electrically connected to the outer terminal of the cigarette lighter accessory socket.

8. The apparatus of claim 5 wherein the spring of the first conductor is located entirely within the housing.

9. An apparatus comprising a first conductor;

a second conductor;

a housing wherein the first conductor and the second conductor are attached to the housing;

the first conductor adapted to be electrically connected to a central terminal of a cigarette lighter accessory socket; and the second conductor adapted to be electrically connected to an outer terminal of the cigarette lighter accessory socket;

a first conductive terminal electrically connected to the first conductor;

a second conductive terminal electrically connected to the second conductor;

a first device for electrically connecting and attaching a first electrical lead to the first conductive terminal;

a second device for electrically connecting and attaching a second electrical lead to the second conductive terminal;

wherein the first device is comprised of a first spring and a first spring loaded member and the second device is comprised of a second spring and a second spring loaded member and;

wherein the first electrical lead can be electrically connected and attached to the first conductive terminal by applying a first force to a portion of the first spring loaded member which allows insertion of the first electrical lead into the housing;

wherein the second electrical lead can be electrically connected and attached to the second conductive terminal by applying a second force to a portion of the second spring loaded member which allows insertion of the second electrical lead into the housing; and wherein the portion of the first spring loaded member to which the first force is applied lies outside the housing and the portion of the second spring loaded member to which the second force is applied lies outside the housing.

10. The apparatus of claim 9 wherein the first conductor and the second conductor are electrically connected to a light which lights when both the first conductor is electrically connected to the central terminal of the cigarette lighter accessory socket and the second conductor is electrically connected to the outer terminal of the cigarette lighter accessory socket.

11. A method comprising the steps of applying a first force to a first spring loaded member to create a first opening;

inserting a first electrical lead through the first opening and into a housing;

releasing the first force to cause the first spring loaded member to exert pressure on the first electrical lead to cause the first electrical lead to become electrically connected and attached to a first conductive terminal;

applying a second force to a second spring loaded member to create a second opening;

inserting a second electrical lead through the second opening and into the housing;

releasing the second force to cause the second spring loaded member to exert pressure on the second electrical lead to cause the second electrical lead to become electrically connected and attached to a second conductive terminal;

wherein a first conductor and a second conductor are attached to the housing, the first conductor electrically connected to the first conductive terminal and the second conductor electrically connected to the second conductive terminal;

and further comprising electrically connecting the first conductor with a central terminal of a cigarette lighter accessory socket and electrically connecting the second conductor with an outer terminal of the cigarette lighter accessory socket.

12. The method of claim 11 wherein the first and second spring loaded members each have a portion which lies outside of the housing and the first and second forces are applied to the portions which lie outside of the housing.

13. The method of claim 11 further comprising activating a light when the first and second conductors are electrically connected to the central terminal and the outer terminal, respectively, of the cigarette lighter accessory socket.

14. The method of claim 12 further comprising activating a light when the first and second conductors are electrically connected to the central terminal and the outer terminal, respectively, of the cigarette lighter accessory socket.

15. The method of claim 11 wherein the first conductor is comprised of:

a first portion;

a second portion; and a third portion.

16. The method of claim 15 wherein the first portion of the first conductor is a conductive thimble.

17. The method of claim 15 wherein the third portion of the first conductor is in the form of a spring.

18. The method of claim 11 wherein wherein the spring of the first conductor is located entirely within the housing.

* * * * *